US009510676B2

(12) United States Patent
Tarcy

(10) Patent No.: US 9,510,676 B2
(45) Date of Patent: Dec. 6, 2016

(54) APPLIANCE HEIGHT ADJUSTING ASSEMBLY

(71) Applicant: BSH Home Appliances Corporation, Irvine, CA (US)

(72) Inventor: Scott Tarcy, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 426 days.

(21) Appl. No.: 13/677,339

(22) Filed: Nov. 15, 2012

(65) Prior Publication Data

US 2014/0132147 A1 May 15, 2014

(51) Int. Cl.

| | |
|---|---|
| ***A47B 57/06*** | (2006.01) |
| ***A47L 15/50*** | (2006.01) |
| ***A47B 88/04*** | (2006.01) |

(52) U.S. Cl.

CPC ..... *A47B 57/06* (2013.01); *A47B 88/0485* (2013.01); *A47L 15/504* (2013.01); *A47L 15/506* (2013.01); *A47L 15/507* (2013.01); *A47B 2210/05* (2013.01); *A47B 2210/17* (2013.01)

(58) Field of Classification Search

CPC . A47B 57/06; A47B 88/0485; A47B 2210/05; A47B 2210/17; A47B 2210/0024; A47B 2210/0059; A47B 45/00; A47B 46/00; A47B 2088/0448; F25D 25/022; F25D 25/024; F25D 25/025; A47L 15/504; A47L 15/506; A47L 15/507

USPC ..... 312/311, 410, 228.1, 349–350, 330.1, 312/334.2–334.4, 334.7–334.8, 221, 312/306–307, 408, 323, 402, 404, 312/131–132; 104/96, 102, 104/106–107; 211/41.8, 126.15, 151, 162; 134/137, 144, 134/147, 148, 151, 164; 248/244, 248/298.1

See application file for complete search history.

(56) References Cited

U.S. PATENT DOCUMENTS

| | | | | |
|---|---|---|---|---|
| 2,486,564 A | * | 11/1949 | Kamin | 126/41 E |
| 2,987,363 A | * | 6/1961 | Morse | 312/274 |
| 3,306,694 A | | 2/1967 | Hauser | |
| 3,973,814 A | * | 8/1976 | Entrikin | 312/333 |
| 4,986,616 A | * | 1/1991 | Chang et al. | 312/323 |
| 5,447,146 A | | 9/1995 | Nickerson | |

(Continued)

FOREIGN PATENT DOCUMENTS

SE EP 2820998 A1 * 1/2015 ..... A47L 15/504

OTHER PUBLICATIONS

Kenneth Chin et al., Assistive Oven Door and Rack Combination, University of Michigan Hospital, online, Dec. 9, 2008.

*Primary Examiner* — Daniel J Troy

*Assistant Examiner* — Ryan A Doyle

(74) *Attorney, Agent, or Firm* — Michael E. Tschupp; Andre Pallapies

(57) ABSTRACT

A rack height adjusting assembly for use in an appliance having at least one inner bar attached to an interior wall of the appliance, each inner bar having an inner and outer end, the assembly comprising at least one guide bar having a distal and proximal end and adapted to be movably attached to a corresponding inner bar, each guide bar adapted to be releasably positioned at its proximal end to the outer end of the corresponding inner bar, each guide bar and each corresponding inner bar adapted to define a continuous track, said track defining a first and second horizontal section, said first and second horizontal sections being positioned at different heights, and a rack adapted to move along the continuous track between a retracted and extended position, (Continued)

said retracted position corresponding to said first horizontal section and said extended position corresponding to said second horizontal section.

36 Claims, 13 Drawing Sheets

(56) References Cited

U.S. PATENT DOCUMENTS

| | | | | |
|---|---|---|---|---|
| 5,671,986 | A * | 9/1997 | Vinet | 312/334.8 |
| 5,860,716 | A * | 1/1999 | Good et al. | 312/311 |
| 6,039,422 | A * | 3/2000 | Butters et al. | 312/334.1 |
| 6,247,771 | B1 | 6/2001 | Miller | |
| 7,731,805 | B2 | 6/2010 | Banta et al. | |
| 7,775,378 | B2 | 8/2010 | Tynes et al. | |
| 7,862,664 | B2 | 1/2011 | Choi et al. | |
| 2004/0163687 | A1* | 8/2004 | Son et al. | 134/58 D |
| 2006/0049731 | A1* | 3/2006 | Choi | A47B 88/08 312/330.1 |
| 2008/0129168 | A1* | 6/2008 | Banta et al. | 312/333 |
| 2009/0193836 | A1* | 8/2009 | Ertz et al. | 62/449 |
| 2011/0062101 | A1* | 3/2011 | Todd, Jr. | 211/144 |

* cited by examiner

APPLIANCE HEIGHT ADJUSTING ASSEMBLY

FIELD OF THE TECHNOLOGY

The present technology relates to appliances, e.g. dishwashers and ovens. More particularly, the present technology relates to a system for a rack that adjusts the height of the rack vertically outside of the appliance to improve the ergonomics of the appliance and to make the appliance easier to load and unload.

BACKGROUND OF THE TECHNOLOGY

In most kitchens today, a number of appliances are sized so that they do not rise above counter-level or are even covered over by counter space and they are designed to be accessed laterally. The purpose of this is to maximize counter space for food preparation, cleaning, etc. Appliances, therefore, incorporate a variety of mechanisms to remove and load their contents by moving the contents horizontally. A typical system by which the rack of an appliance is moved horizontally to facilitate loading and unloading is shown in U.S. Pat. No. 7,909,420 B2. This may present a difficulty to the user, however, in that the user must bend over to reach the rack that holds the contents.

Several attempts have been made to make the rack of an appliance more accessible. For example, U.S. Pat. No. 7,731,805 B2 shows a system of linkages by which a dishwasher rack swings out and up. In U.S. Pat. No. 6,247,771 B1 the rack is lifted by a scissoring motion of support bars driven by a screw. U.S. Pat. No. 7,862,664 B2 shows a basket with different mounting points wherein the user adjusts which rack mounting points rest on a frame to vary the height of the basket. Finally, U.S. Pat. No. 7,775,378 B2 shows a system where the rack is pulled out horizontally, then lifted and set to a desired height with a sprung system.

A need has developed to address one or more shortcomings of the prior art.

SUMMARY OF THE TECHNOLOGY

One aspect of the present technology is to provide an appliance with a rack system that overcomes one or more of the shortcomings of the prior art.

Another aspect of the present technology is directed to a rack height adjusting assembly for use in an appliance, e.g. a dishwasher or oven, having at least one inner bar fixedly attached to an interior wall of the appliance, each inner bar having an inner end and an outer end. The assembly comprises at least one guide bar adapted to be movably attached to said at least one inner bar and having a distal end and a proximal end, said guide bar adapted to be releasably positioned at its proximal end to the outer end of the at least one inner bar, said at least one guide bar adapted to define along with said at least one inner bar a continuous track, said track defining a first horizontal section and a second horizontal section, said first and second horizontal sections being positioned at different heights; and a rack adapted to move along the continuous track between a retracted position and an extended position, said retracted position corresponding to said first horizontal section and said extended position corresponding to the second horizontal section.

In examples, (a) the at least one guide bar may be adapted to be releasably locked at its proximal end to the outer end of the at least one inner bar, (b) the proximal end of the at least one guide bar may be adapted to be rotatably attached to the outer end of the at least one inner bar, (c) the at least one guide bar may be adapted to move longitudinally relative to the at least one inner bar, (d) there may be at least one extendable support bar having a proximal end and a distal end, wherein said proximal end is adapted to be fixedly attached to the interior wall of the appliance and said distal end is fixedly attached to the guide bar, (e) there may be one or more wheels attached longitudinally and coplanar at the proximal end of the at least one guide bar, and a longitudinal channel may be disposed on the at least one inner bar and adapted to rollably attach the proximal end of the at least one guide bar by the at least two wheels, and/or (f) the guide bar may be substantially S-shaped.

Another aspect of the present technology is directed to a method for facilitating the loading and unloading of items to be treated (e.g., washed, dried, cooked, etc.) in an appliance, the appliance having at least one guide bar with a proximal end and a distal end, and at least one inner bar having an inner end and an outer end and fixedly attached to an interior wall of the appliance. The method comprises pulling out the at least one guide bar from the appliance, said at least one guide bar adapted to be movable relative to the at least one inner bar, and moving a rack from the at least one inner bar to the at least one guide bar such that the rack moves from a first height to a second height that is different from the first height.

In examples, the method may include (a) releasably locking said at least one guide bar at its proximal end to the at least one inner bar at its outer end to form a continuous track, (b) rotating the at least one guide bar about its proximal end, said proximal end adapted to be rotatably attached to the outer end of the at least one inner bar, (c) extending an at least one extendable support bar having a proximal end and a distal end, wherein said proximal end is adapted to be fixedly attached to the interior wall of the appliance and said distal end is adapted to be fixedly attached to the guide bar, wherein the at least one guide bar is adapted to move longitudinally relative to the at least one inner bar, (d) pulling out the at least one guide bar and moving the rack simultaneously, (e) pulling out the at least one guide bar before the step of moving the rack, (f) pushing the at least one guide bar into the appliance simultaneous with moving the rack from the at least one guide bar to the at least one inner bar such that the rack moves from the second height to the first height, and/or (g) pushing the at least one guide bar into the appliance, and subsequently moving the rack from the at least one guide bar to the at least one inner bar such that the rack moves from the second height to the first height.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

The accompanying drawings facilitate an understanding of the various examples of the present technology. In such drawings.

DETAILED DESCRIPTION OF ILLUSTRATED EXAMPLES

The following description is provided in relation to several examples which may share common characteristics and features. It is to be understood that one or more features of any one example may be combinable with one or more features of the other examples. In addition, any single feature or combination of features in any of the examples may constitute additional examples.

Figure 1A:
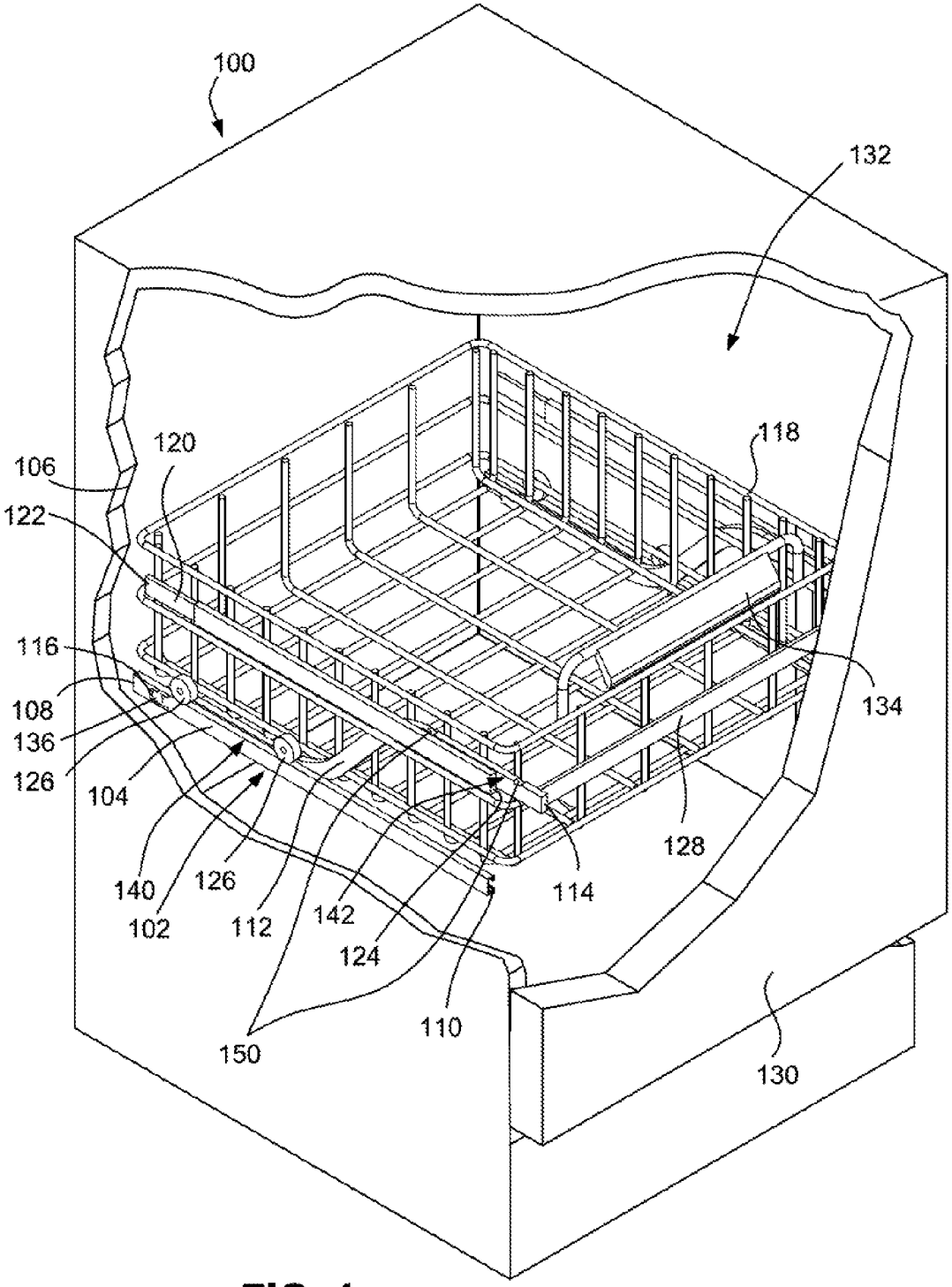
FIG. 1*a* shows a cut-away, perspective view of an appliance having a rack height adjusting assembly in a retracted position, according to an example of the present technology.

FIG. 1*a* shows a perspective of view of a household appliance 100 having a door 130 for enclosing the inner chamber 132. The appliance 100 in this example is a dishwasher for washing and/or drying items, such as crockery, glassware, dishes, frying pans, cookie sheets, cutting boards, bowls, pots, etc. The door 130 will form a generally water/air tight seal relative to the inner chamber 132 when closed. Installed within the inner chamber of the appliance, and shown by a cut-away of the appliance, is a rack height adjusting assembly 102 for facilitating the loading and unloading of items to be treated in the appliance 100. It should be appreciated, however, that the appliance is not limited to a dishwasher and could be any other common appliance, e.g. an oven.

The rack height adjusting assembly 102 is in a retracted position within the inner chamber 132 of the appliance 100 and the rack 118 is at a first horizontal section 140 on the inner bars 104. The rack 118 is resting on a pair of inner bars 104 by way of rack wheels 126. The rack 118 has a handle 134 for moving the rack in and out of the appliance 100. The first horizontal section 140 will be described in greater detail below, with respect to FIGS. 3*b*, 4, and 5*b*.

The inner bars 104 have an inner end 108 and an outer end 110, and are fixedly attached to respective sides of an interior wall 106 of the appliance 100.

A pair of guide bars 112 is attached or otherwise coupled to respective inner bars 104 such that the guide bars 112 can move relative to the inner bar 104. Each guide bar 112 has a distal end 114 and a proximal end 116. The proximal end 116 of each guide bar 112 is adapted to be releasably positioned to the respective outer end 110 of the inner bar 104. The guide bar 112 is substantially S-shaped. At least one cross-bar 128 connects the guide bars 112 so that they can be moved in unison. The guide bars 112 may also be moved independently of one another in an example where the cross-bar does not connect the guide bars. The guide bars 112 also have detents 150 in which the rack wheels 126 may rest to stabilize the rack 118.

An extendable (e.g. telescoping) support bar 120 is fixedly attached at a proximal end 122 to the interior wall 106 of the appliance 100. A distal end 124 of the extendable support bar 120 is fixedly attached to the guide bar 112.

Figure 1B:
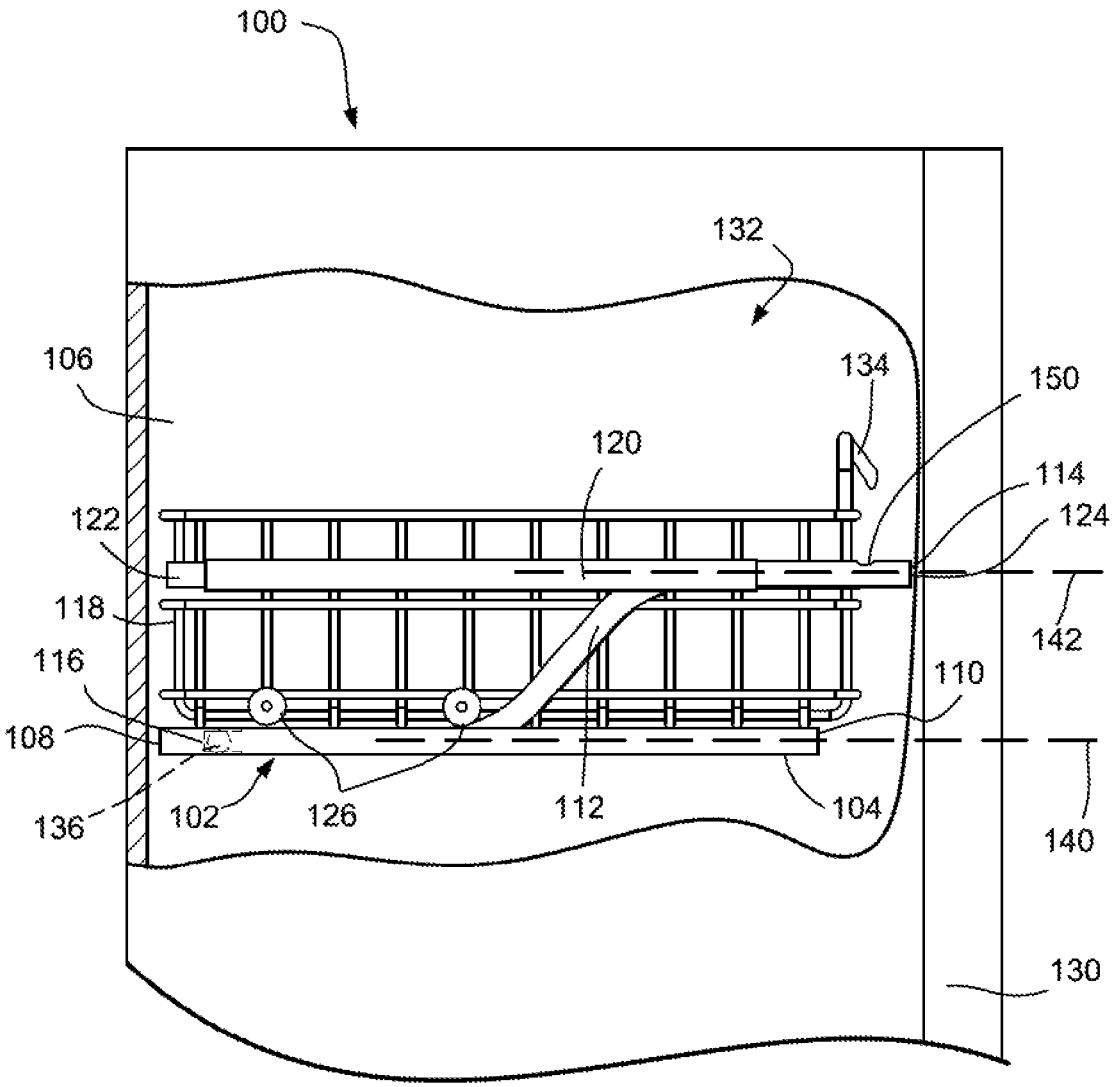
FIG. 1*b* partially shows a cut-away, side view thereof.

FIG. 1*b* shows a cut-away, side view of the rack height adjusting assembly 102 installed within the inner chamber 132 of the appliance 100. The rack 118 and its rack wheels 126 are resting on the inner bar 104 at a first horizontal section 140 and the rack height adjusting assembly 102 is in a retracted position. The door 130 is closed, enclosing the rack height adjusting assembly 102.

Figure 2:
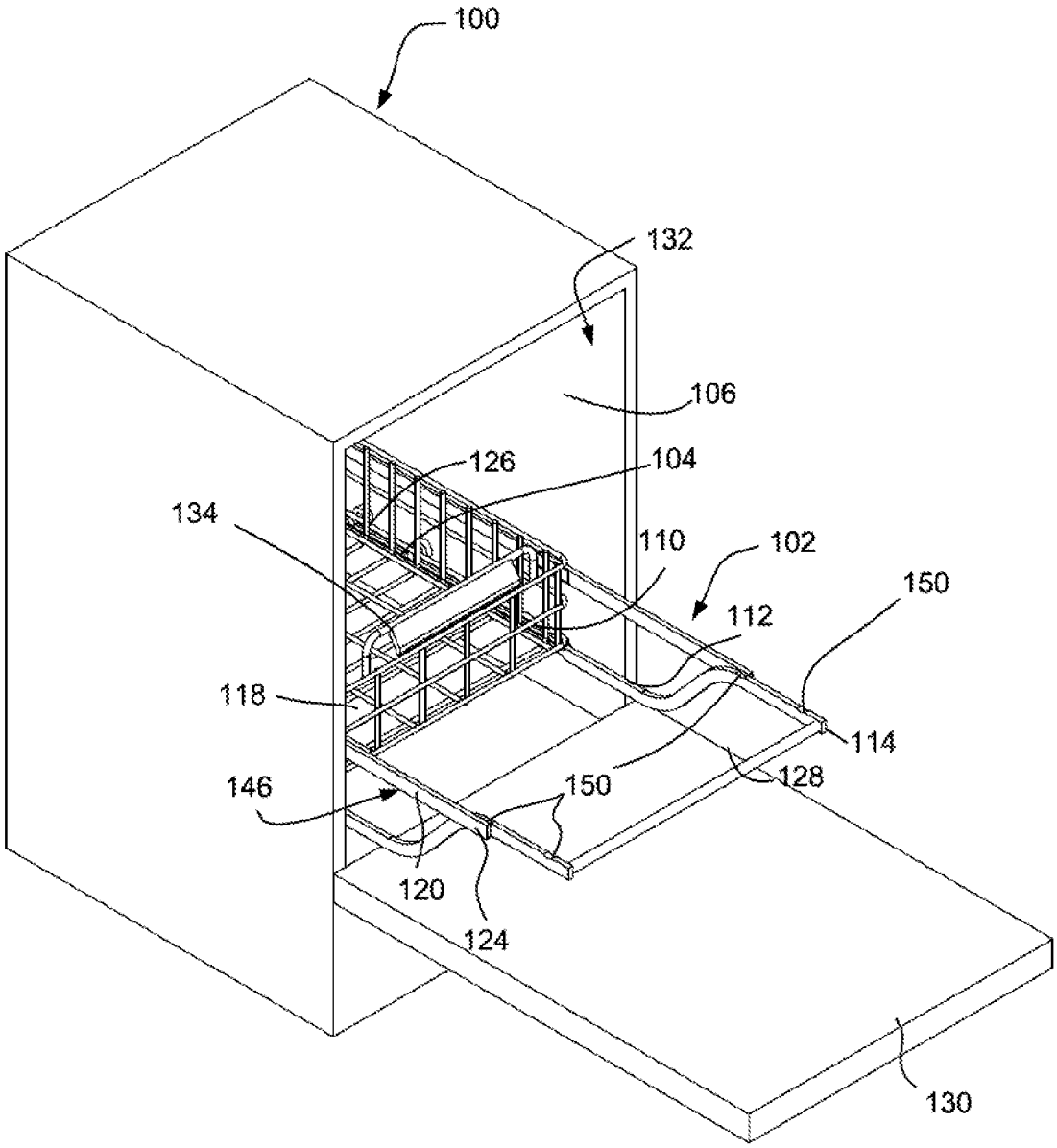
FIG. 2 shows a perspective view of an appliance having a rack height adjusting assembly with a rack resting on a first horizontal section of a continuous track and the assembly in an extended position, according to an example of the present technology.

FIG. 2 shows a perspective view of the appliance 100 with the door 130 open, exposing the rack height adjusting assembly 102 and the inner chamber 132 of the appliance.

The rack height adjusting assembly 102 is in an extended position. By pulling out the guide bars 112 they will move out longitudinally and in unison, e.g., by virtue of being connected by a cross-bar 128. The guide bars 112 can also be pulled out by the cross-bar 128. When in the extended position, the proximal ends 116 of the guide bar 112 are releasably positioned at respective outer ends 110 of the inner bar 104. The extendable support bars 120 are attached at their proximal ends 122 to respective interior walls 106 of the appliance 100 and at their distal ends 124 to respective guide bars 112. The extendable support bars 120 extend telescopically when the guide bars 112 to which they are attached are pulled out. By extending the guide bars 112 and positioning their proximal ends 116 at the outer ends 110 of the inner bars 104, a continuous track 146 is extended from the appliance 100, along which the rack 118 may move.

In this example, the extendable support bars 120 are optional and provide additional support to the guide bars 112 to aid in maintaining their position vertically as the guide bars are moved from the inner chamber 132.

Figure 3A:
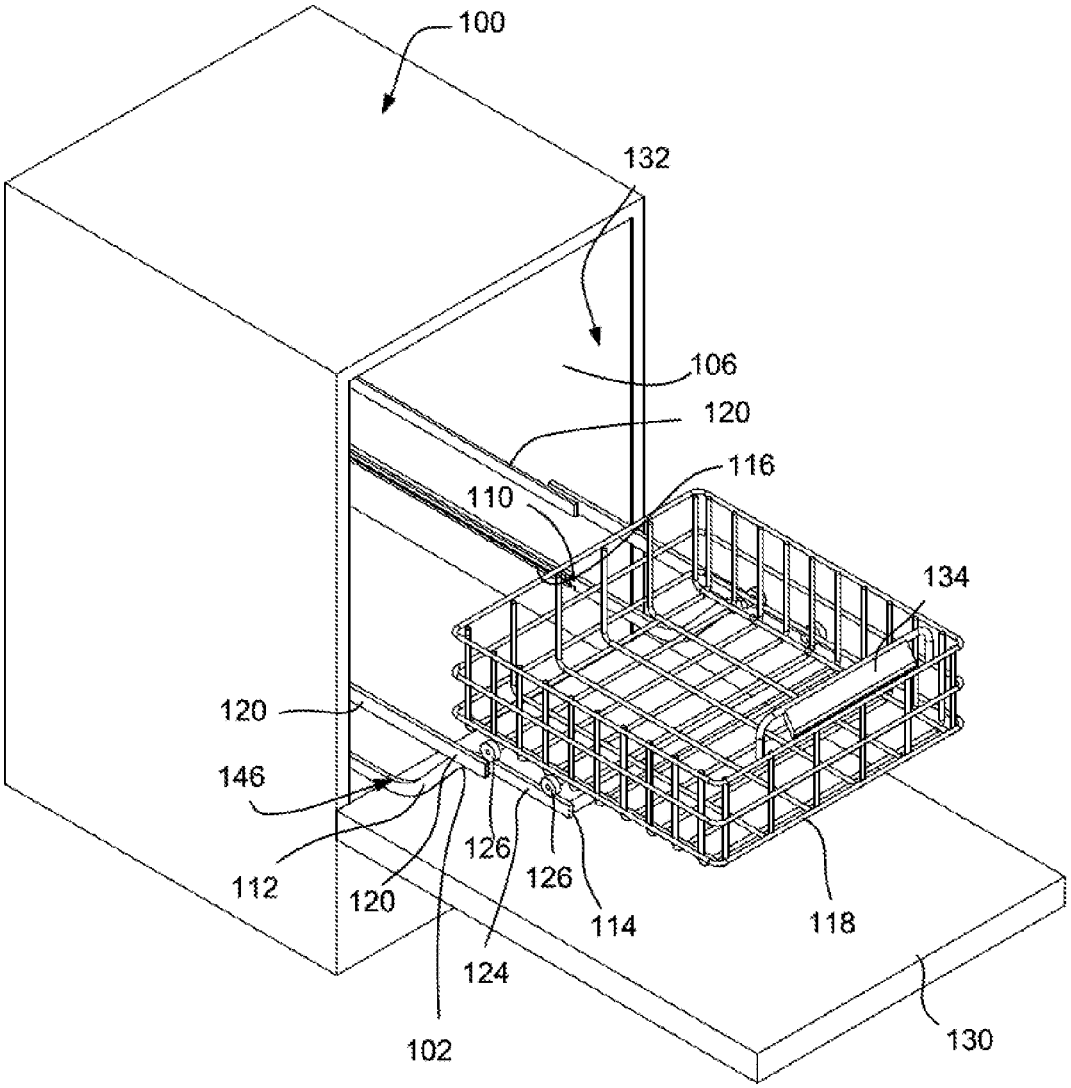
FIG. 3*a* shows a perspective view of an appliance having a rack height adjusting assembly with a rack resting on a second horizontal section of a continuous track and the assembly in an extended position, according to an example of the present technology.

FIG. 3*a* shows a perspective view of the appliance 100 with the door 130 open, exposing the rack height adjusting assembly 102 and the inner chamber 132 of the appliance.

The rack height adjusting assembly 102 and the rack 118 are in an extended position, thereby exposing the rack 118 to facilitate the loading or unloading of items to be treated by the appliance 100. When the guide bars 112 and cross-bar 128 are pulled out to the extended position as shown in FIG. 2, the continuous track 146 is extended and lengthened. FIG. 3*a* shows the rack 118 in an extended position and moved along the continuous track 146 to a second horizontal section 142 that is defined on the guide bars 112. The rack 118 moves by rolling along the continuous track 146 on wheels 126 and the rack 118 can be pulled by the handle 134.

Figure 3B:
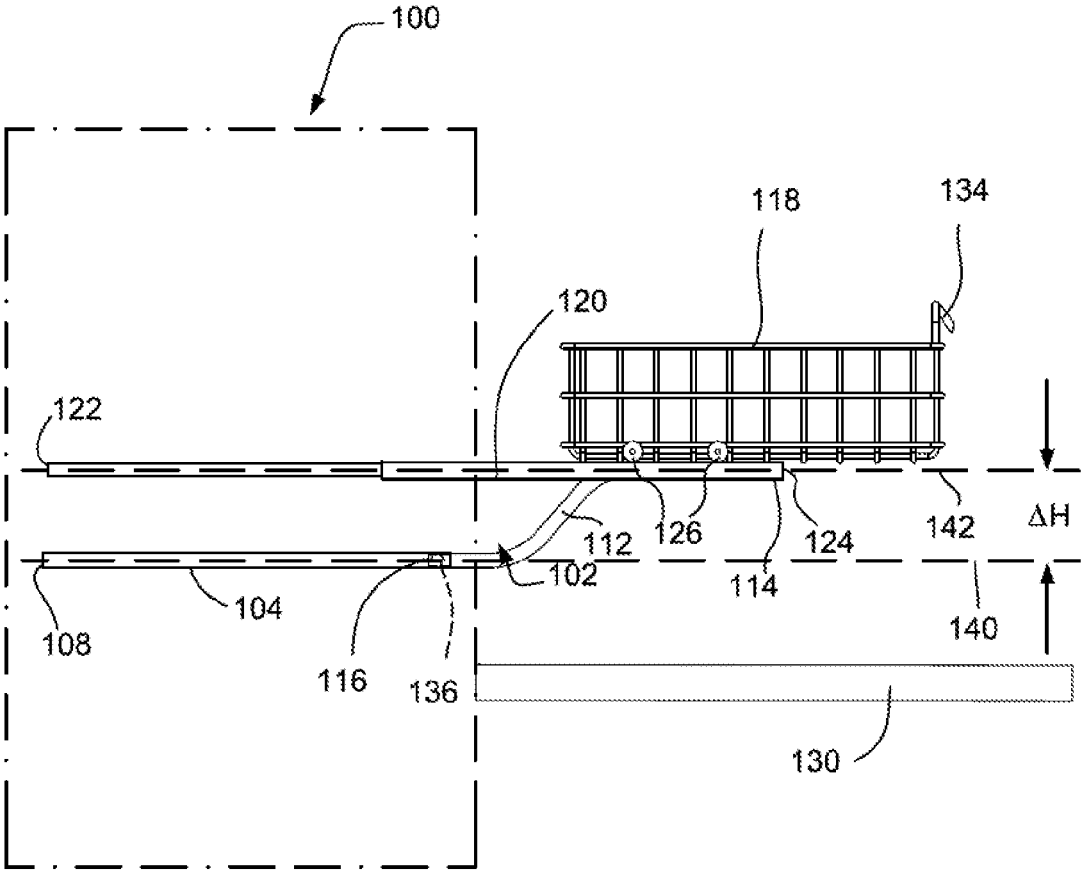
FIG. 3*b* shows a side view of an appliance having a rack height adjusting assembly with a rack resting on a second horizontal section of a continuous track and the assembly in an extended position, according to an example of the present technology.

FIG. 3*b* shows a side view of the appliance 100 with the door 130 open, exposing the rack height adjusting assembly 102 and the inner chamber 132 of the appliance. As in FIG. 3*a*, the rack 118 and the rack height adjusting assembly 102 are in an extended position. In FIG. 3*b*, the first horizontal section 140 is shown with a dashed line defined on the inner bar 104. The second horizontal section 142, where the rack 118 is located in this view, is defined by another dashed line on the guide bar 112. The first horizontal section 140 and the second horizontal section 142 are shown at different heights, where the height differential between the first horizontal section and the second horizontal section is defined as ΔH and may be up to 20 cm. In FIG. 3*b* the second horizontal section 142 is higher than the first horizontal section 140, however it should be understood that the rack height adjusting assembly 102 could be inverted such that the second horizontal section 142 is lower than the first horizontal section 140, e.g. if the appliance were mounted at a high level relative to the user.

The rack 118 will begin in the first horizontal section 140 on the inner bars supported, in this example, by wheels 126 that allow it move along the continuous track 146 by rolling. The wheels 126 may be flanged on one or both edges to retain the rack 118 on the continuous track 146 as it moves. The inner bars 104 and the guide bars 112 may incorporate a lip running their length along the surface which the rack wheels 126 contact as another way to retain the rack 118 on the continuous track. The continuous track 146 having already been extended by pulling out the guide bars 112, the rack 118 is rolled along the continuous track to the second horizontal section 142 on the guide bars. The rack 118 will have moved upward by a distance of ΔH once it is completely rolled onto the guide bars 112 at the second horizontal section 142.

It is also envisioned that the rack 118 could be moved along the continuous track 146 by means other than rolling, e.g. sliding. The rack 118 could be adapted to slide along the portions of the guide bars 112 and inner bars 104 that comprise the continuous track 146 by contact between low-friction surfaces.

It is also envisioned that the rack 118 could be moved along the continuous track 146 by a means similar to a conveyor belt. The guide bars 112 and inner bars 104 may alternatively comprise a series of rollers or ball bearings along the surface that defines the continuous track 146. The rack 118 would rest upon the surfaces of the continuous track 146 by way of substantially flat surfaces, like skis, that are adapted to span at least two apexes of the rollers or ball bearings at the contact surface of the continuous track 146, thereby facilitating smooth travel of the track 118 along the continuous track 146.

Figure 7:
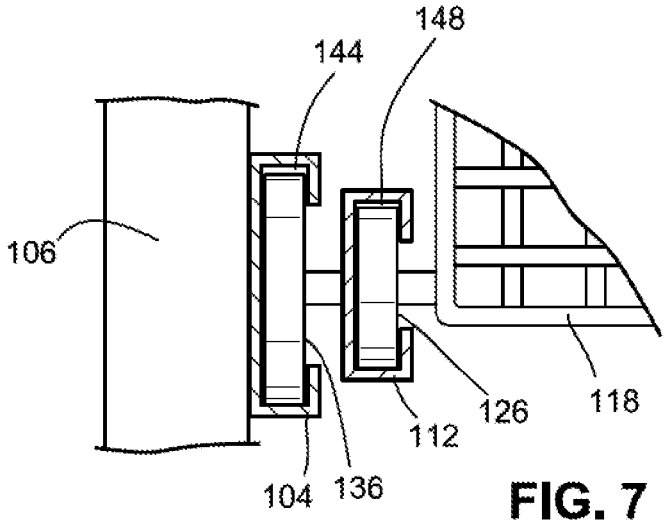
FIG. 7 shows a detailed cross sectional view of an example of the rack height adjusting assembly.

The telescoping mechanism shown in the cross-sectional view of FIG. 7 is another example of how the rack 118 may be moved from the first horizontal section 140 to the second horizontal section 142. In this example, the inner bars 104 are fixedly attached to respective interior walls 106 and the inner bars have a C-shaped cross section defining an inner bar channel 144 through which at least one guide bar wheel 136 rolls. Each guide bar wheel 136 is attached to a respective guide bar 112, e.g., at its proximal end 116. This allows the guide bar 112 to move longitudinally relative to the inner bar 104. The inner end 108 and outer end 110 of each inner bar channel 144 would be closed to prevent the guide bar wheels 136 from rolling completely out of the inner bar 104.

The rack 118 has at least one rack wheel 126 attached thereto which travels in a guide bar channel 148 defined by the C-shaped cross section of the guide bar 112. This allows the rack 118, to travel longitudinally and vertically relative to the appliance 100, thus adjusting its height. As with the inner bar channel 144, the guide bar channel 148 will be closed at both ends to prevent the rack wheels 126 from rolling completely out.

Also, in this example the rack 118 may be pulled from the first horizontal section 140 to the second horizontal section 142 in one simultaneous motion. In the example shown in FIGS. 6*a* and 6*b*, the guide bars 112 must be pulled out to extend the continuous track 146 prior to moving the rack 118 to bring the inner bars 104 flush with the guide bars 112. However, in this example the guide bars 112 and the rack 118 are able to move independently through their complete ranges of motion, whether they are in the retracted or extended position. Thus, pulling the rack 118 would bring the guide bars 112 with it and fully extend the rack height adjusting assembly 102 in one motion. Additionally, a reverse snap-fit lever may be included in the assembly that would operate to facilitate retracting the guide bars 112 and rack 118.

Figure 4:
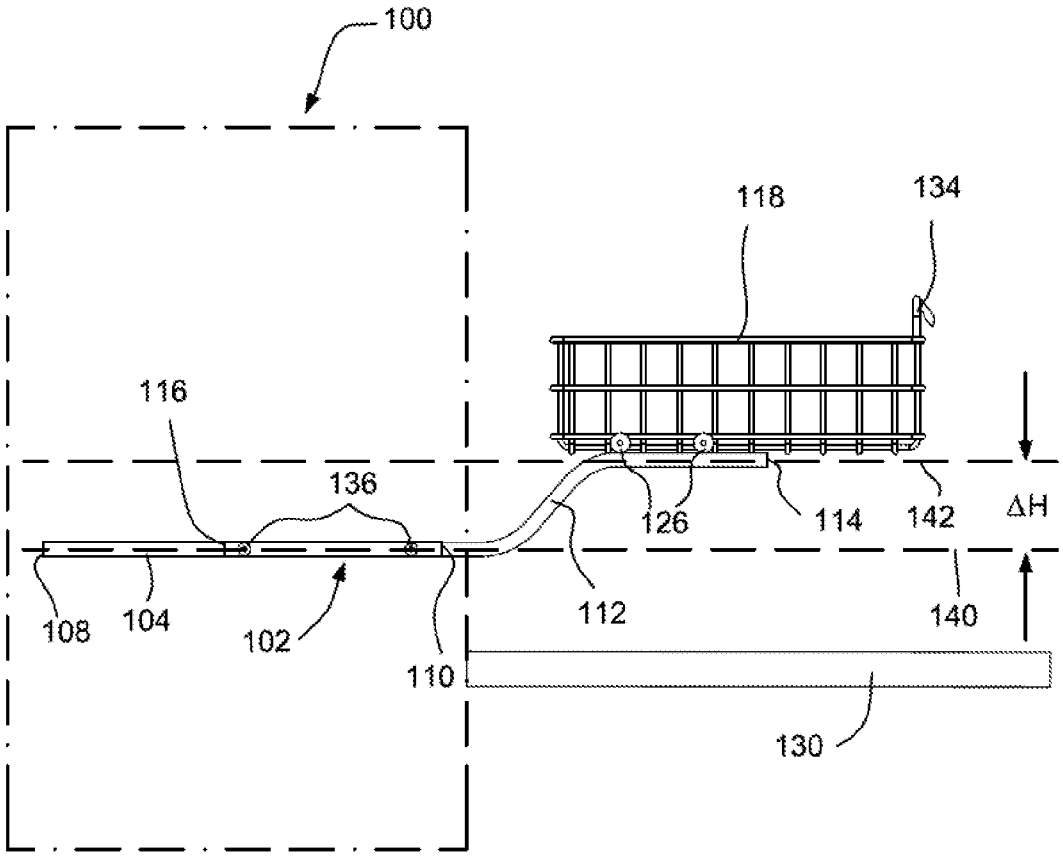
FIG. 4 shows a side view of an appliance having a rack height adjusting assembly with a rack resting on a second horizontal section of a continuous track and the assembly in an extended position, according to another example of the present technology.

FIG. 4 shows a side view of the appliance 100 with the door 130 open, exposing the rack height adjusting assembly 102 and the inner chamber 132 of the appliance. As in FIG. 3*a*, the rack 118 and the rack height adjusting assembly 102 are in an extended position. In the example shown in this view there is no extendable support bar 120 to support the guide bars 112 in the extended position. The guide bars 112 of this example are supported relative to the inner bar 104 by at least two guide bar wheels 136 running within a longitudinal channel (not shown in this view) of the inner bars 104.

Figure 5A:
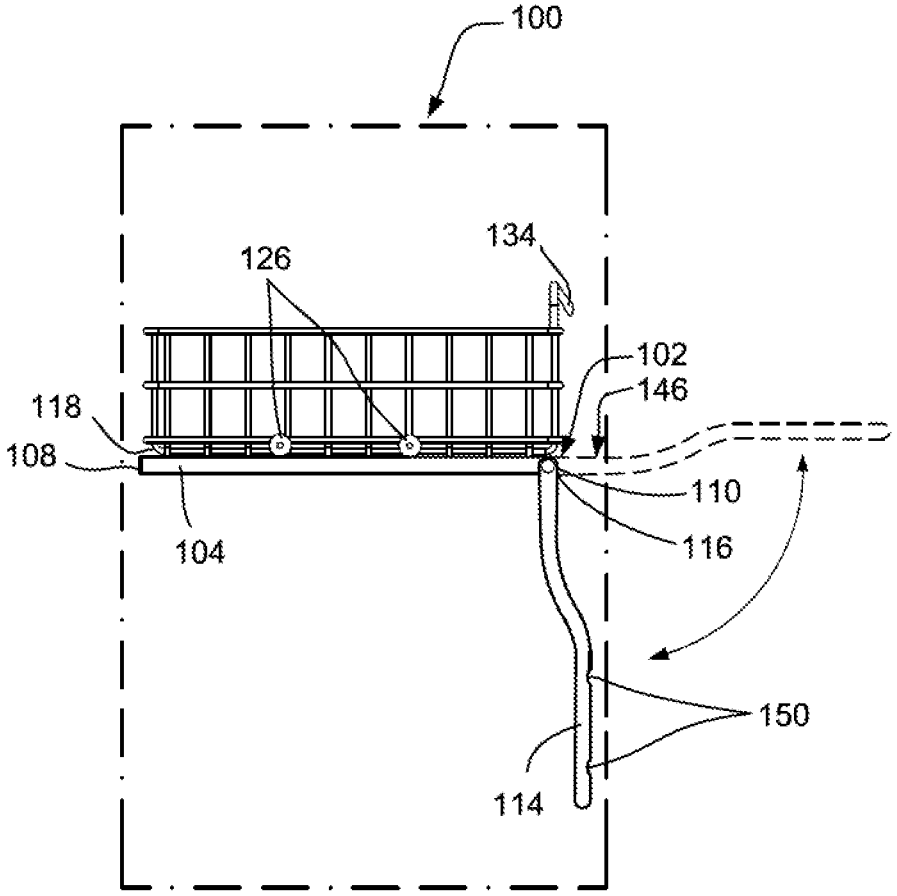
FIG. 5*a* shows a side view of an appliance having a rack height adjusting assembly with a rack resting on a first horizontal section of a continuous track and the assembly in an retracted position, according to another example of the present technology.

FIG. 5*a* shows a side view of another example of the present technology. In this example, the guide bar 112 is rotatably attached at its proximal end 116 to the outer end 110 of the inner bar 104. This view shows the rack 118 and the rack height adjusting assembly 102 in a retracted position, with the rack 118 on the first horizontal section 140. The guide bars 112 may be connected by a cross-bar 128, as shown in FIG. 1*a*, for example. Alternatively, the cross-bar may not be present to attach the guide bars such that they move independently of one another.

Figure 5B:
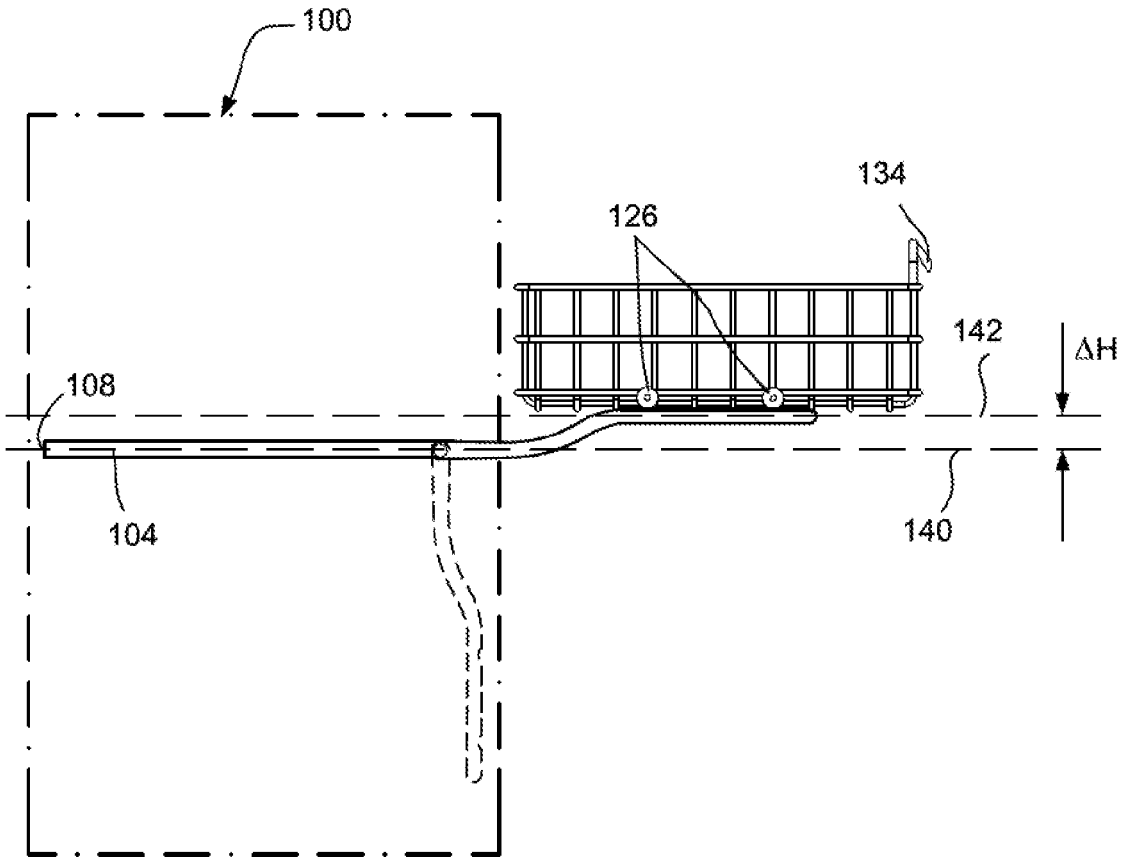
FIG. 5*b* shows a side view of an appliance having a rack height adjusting assembly with a rack resting on a second horizontal section of a continuous track and the assembly in an extended position, according to another example of the present technology.

FIG. 5*b* shows a further side view of the appliance 100 where the rack 118 and the rack height adjusting assembly 102 are in an extended position. The guide bar 112 is rotated upward and outward from the inner chamber 132 and releasably positioned to form the continuous track 146. The rack 118 is then moved along the continuous track 146 by wheels 126 to the second horizontal section 142.

Figure 6A:
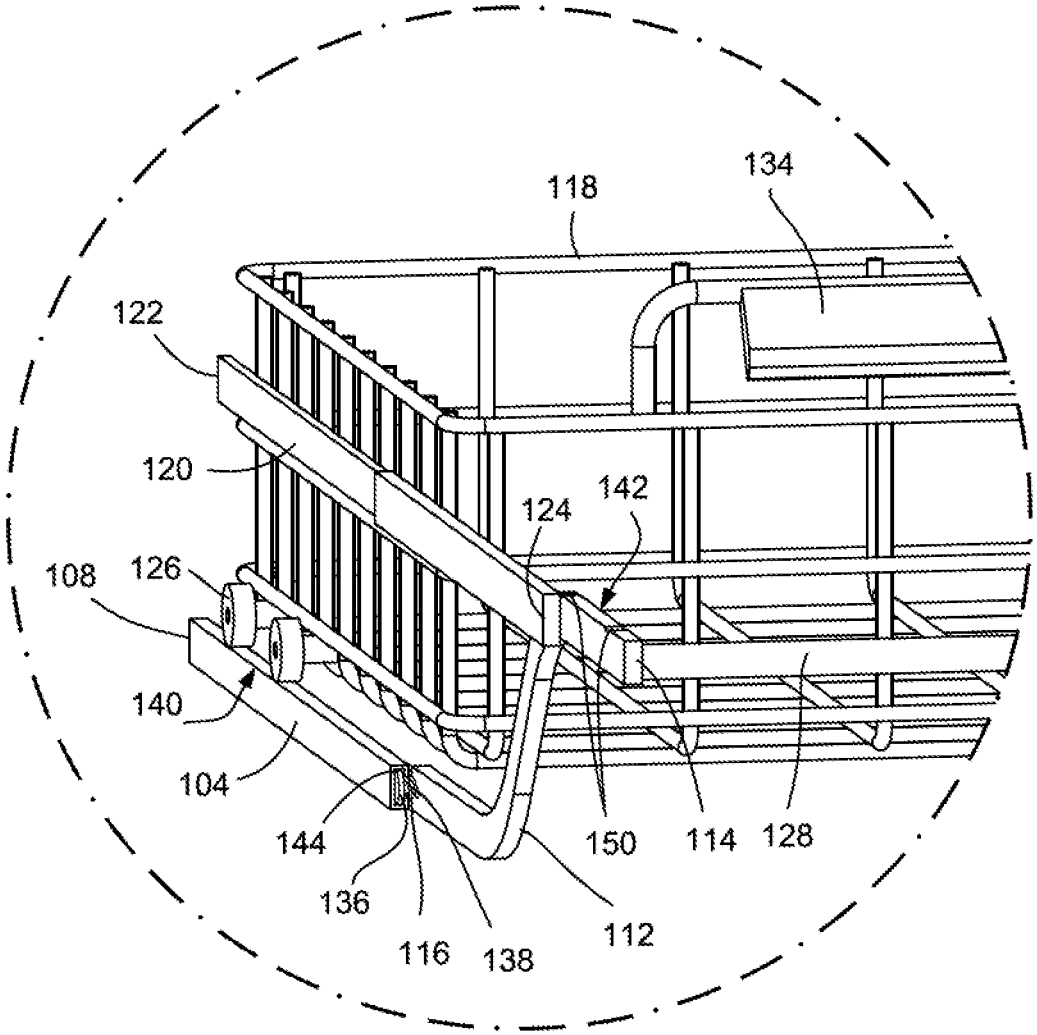
FIG. 6*a* shows a detailed perspective view of a rack height adjusting assembly with a rack resting on a first horizontal section of a continuous track and the assembly in an extended position, according to an example of the present technology.

FIG. 6*a* is a detailed perspective view of an example of the rack height adjusting assembly 102 and snap fit mechanism by which the guide bar 112 locks into the inner bar 104. The guide bars 112 are in between the retracted and extended positions to better show this mechanism. The rack 118 is in the retracted position and at the first horizontal section 140. The inner bar 104 has an inner bar channel 144 longitudinally disposed on it, such that the inner bar 104 has C-shaped cross section. Within the channel 144 a guide bar wheel 136 passes longitudinally. The guide bar wheel 136 is attached to the proximal end 116 of the guide bar 112 by a spring and axle assembly 138 that allows the guide bar 112 to move laterally relative to the guide bar wheel 136 and inner bar 104. A portion of the proximal end 116 to which the guide bar wheel 136 is attached is profiled such that it can fit within the opening of the inner bar channel 144, thereby releasably locking the proximal end 116 to the outer end 110 of the inner bar 104.

Figure 6B:
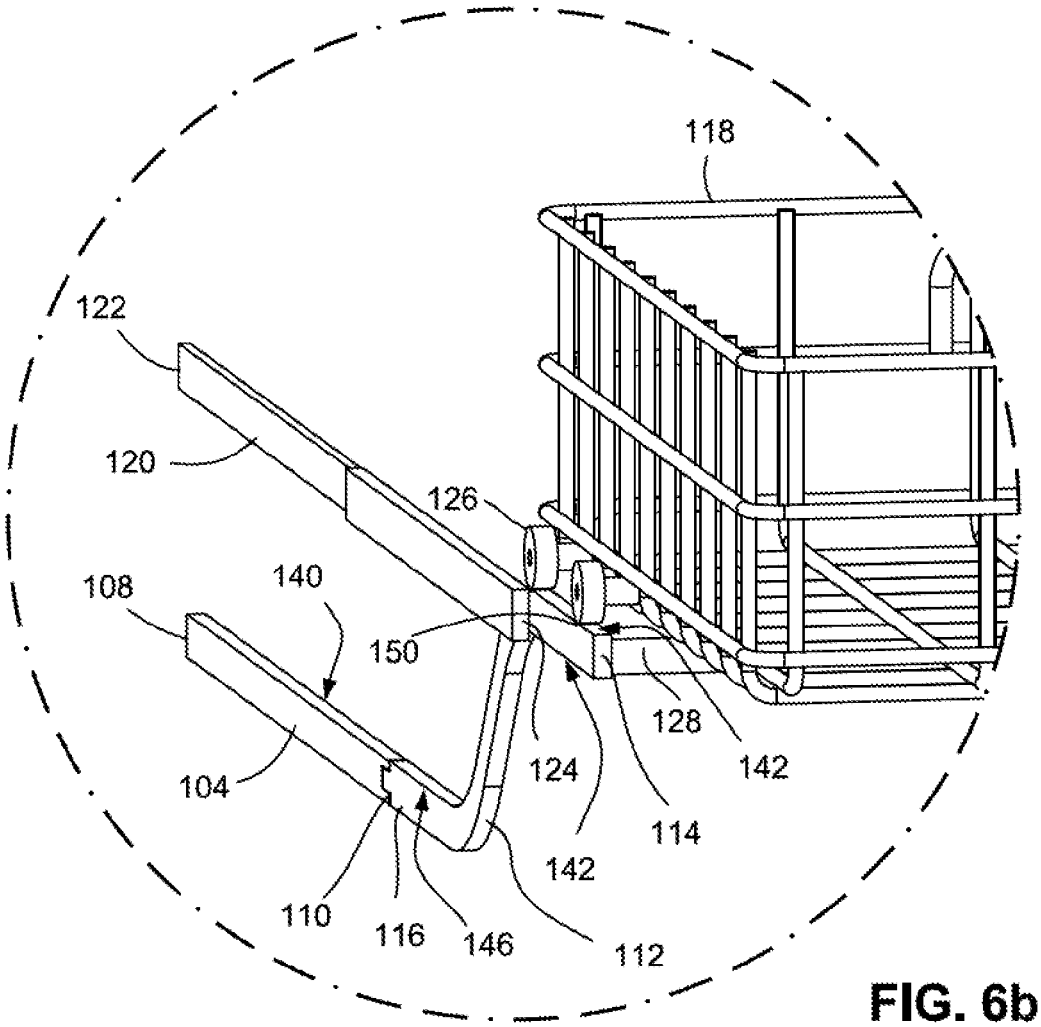
FIG. 6*b* shows a detailed perspective view of a rack height adjusting assembly with a rack resting on a second horizontal section of a continuous track and the assembly in an extended position, according to an example of the present technology.

FIG. 6*b* is a further detailed perspective view of an example of the rack height adjusting assembly 102 and mechanism by which the guide bar 112 locks into the inner bar 104. In this view the proximal end 116 of the guide bar 112 has moved laterally and locked into the outer end 110 of the inner bar 104 to extend the continuous track 146. Both the rack 118 and the guide bars 112 have been fully extended and the rack is at the second horizontal section.

To close the appliance 100, the rack 118 is returned along the continuous track 146 from the second horizontal section 142 to the first horizontal section 140. The rack height adjusting assembly 102 is returned to the retracted position by pushing the proximal ends 116 of the guide bars 112 toward one another to unlock them from the outer ends 110 of the inner bars 104 and moving the guide bars 112 into the inner chamber 132.

Figure 3C:
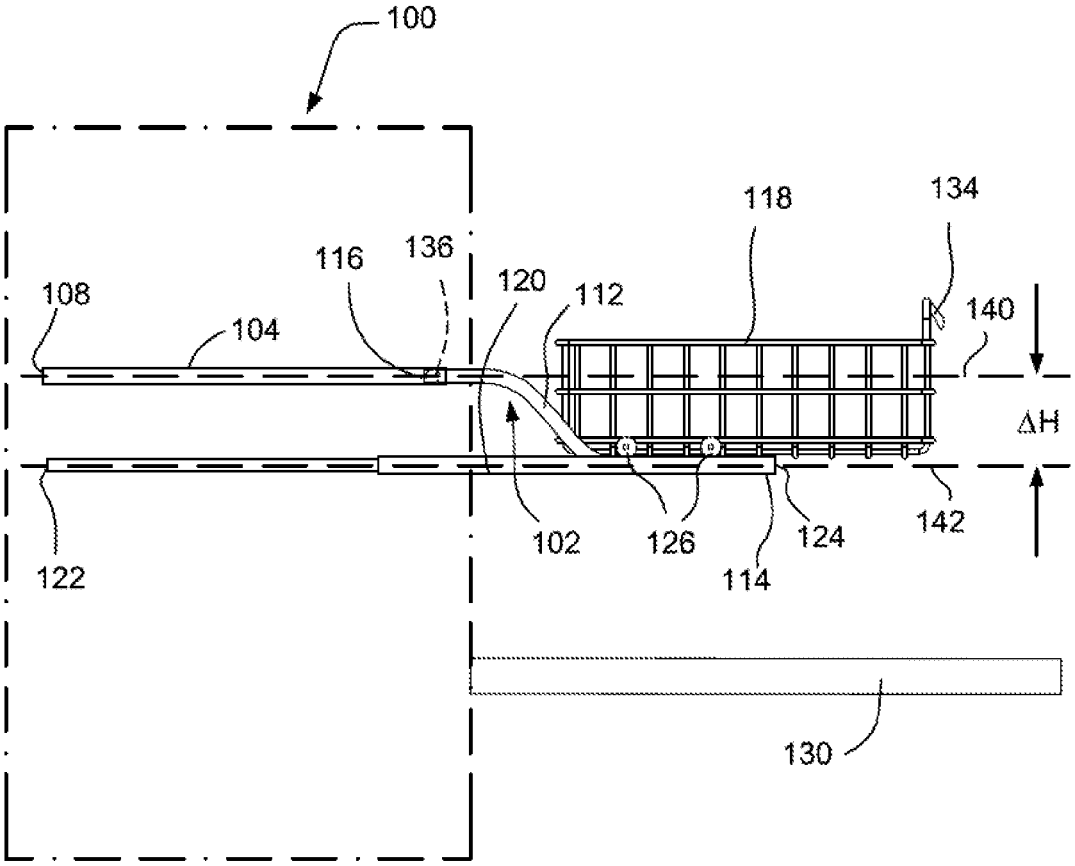
FIG. 3*c* shows a side view of an appliance having a rack height adjusting assembly with a rack resting on a second horizontal section of a continuous track and the assembly in an extended position, according to another example of the present technology.

FIG. 3*b* shows a side view of the appliance 100 with the door 130 open, exposing the rack height adjusting assembly 102 and the inner chamber 132 of the appliance. As in FIG. 3*a*, the rack 118 and the rack height adjusting assembly 102 are in an extended position. In FIG. 3*b*, the first horizontal section 140 is shown with a dashed line defined on the inner bar 104. The second horizontal section 142, where the rack 118 is located in this view, is defined by another dashed line on the guide bar 112. The first horizontal section 140 and the second horizontal section 142 are shown at different heights, where the height differential between the first horizontal section and the second horizontal section is defined as $\Delta H$ and may be up to 20 cm. In FIG. 3*b* the second horizontal section 142 is higher than the first horizontal section 140, however it should be understood that the rack height adjusting assembly 102 could be inverted such that the second horizontal section 142 is lower than the first horizontal section 140, e.g. if the appliance were mounted at a high level relative to the user, as depicted in FIG. 3*c*.

Figure 8:
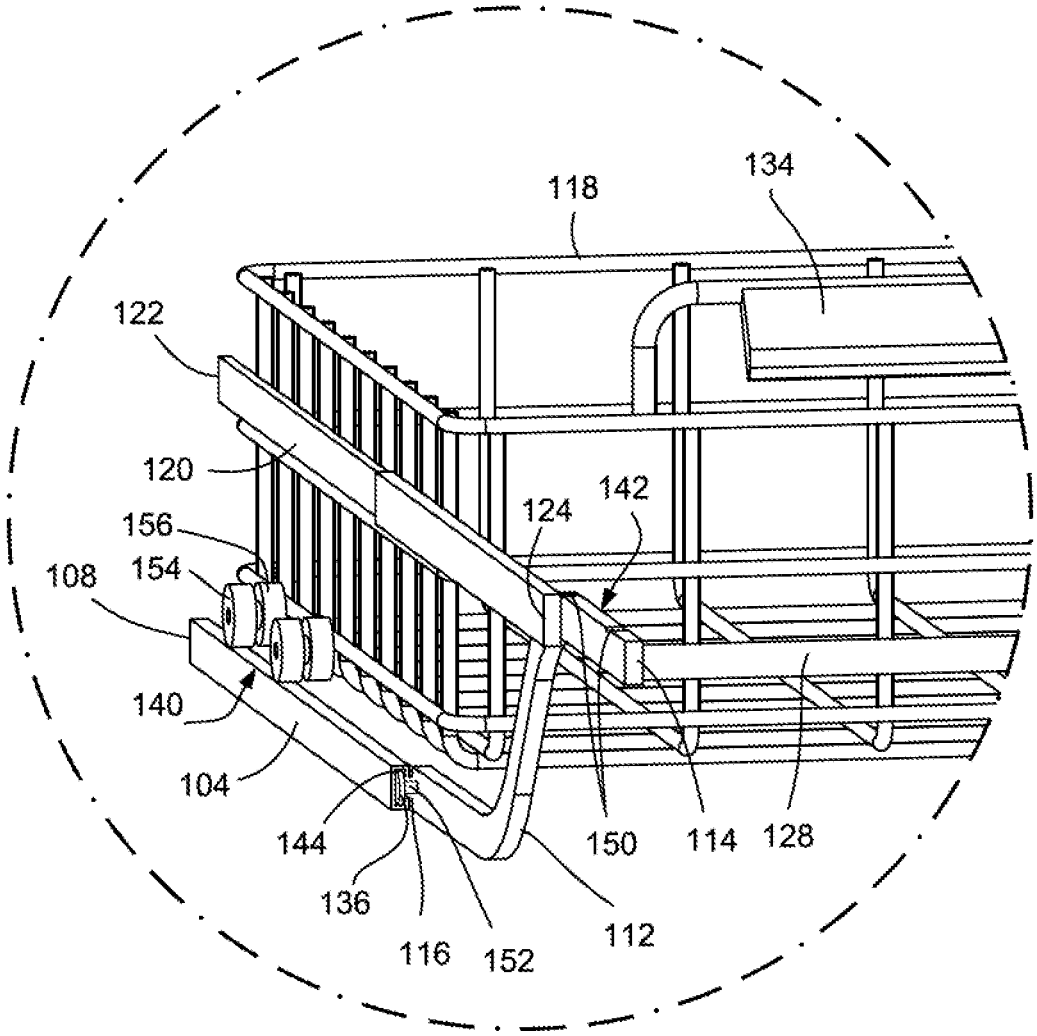
FIG. 8 shows a detailed perspective view of a rack height adjusting assembly with a rack resting on a first horizontal section of a continuous track and the assembly in an extended position, according to an example of the present technology.

An alternative to the locking mechanism described with respect to FIGS. 6*a* and 6*b* to form the continuous track 146 is shown in FIG. 8. In this example the guide bars 112 and inner bars 104 do not lock together flush in the extended position, although the wheel 136 and axle 152 arrangement remains which allows the guide bars 112 to travel longitudinally with respect to the inner bars 104. Rather, the inner bars 104 and the guide bars 112 would remain separated laterally along the length of travel of the guide bars with respect to the inner bars. Any commonly known locking mechanism could, in the extended position, be used to releasably lock the guide bars 112 at their proximal ends 116 to the outer ends 110 of the inner bars 104. The rack 118 would then be able to travel along the continuous track 146 by pairs of coaxial wheels mounted to the rack. In the retracted position the rack 118 would rest on the inner bars 104 by way of inner bar rack wheels 154, and in the extended position the rack 118 would rest on the guide bars 112 by way of guide bar rack wheels 156.

Thus, as the rack 118 travels along the continuous track 146 between retracted and extended positions the rack will be transferred between the inner bar rack wheels 154 on the inner bars 104 and the guide bar rack wheels 156 on the guide bars 112. This view shows the outer end 110 of inner bar 104 open exposing the interior of the inner bar and the wheel 136 and axle 152 arrangement. Therefore, some type of locking mechanism, as previously mentioned, would be required to prevent the guide bars 112 from falling out of the inner bars. Alternatively, it is envisioned that the outer ends could be closed off to stop the guide bars at the outer ends of the inner bars. Closing off the ends or providing locking mechanisms are equally applicable at the inner ends 108 of the inner bars 104 to prevent the guide bars 112 from falling out of the inner bars at the inner ends.

Figure 9:
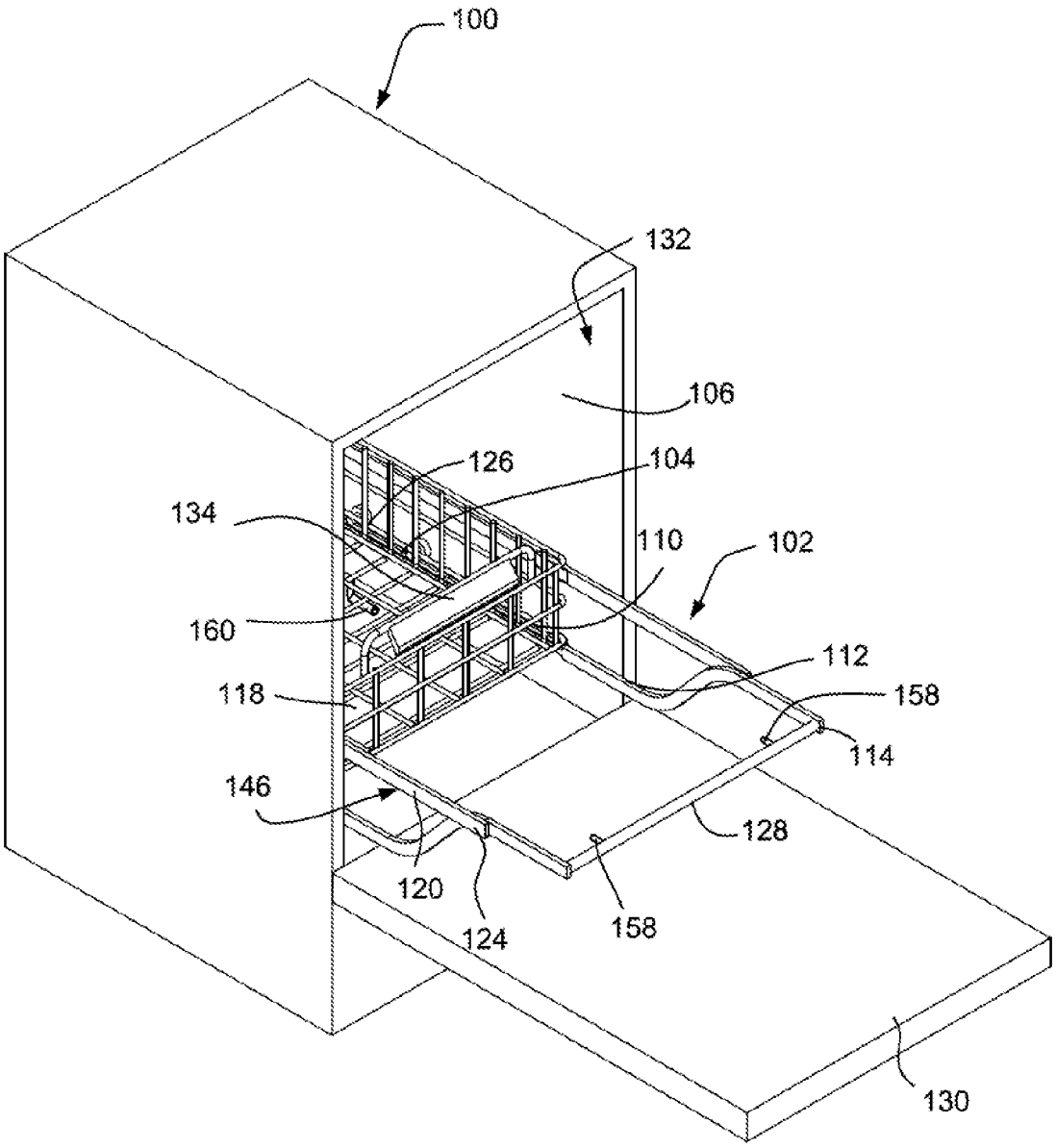
FIG. 9 shows a perspective view of an appliance having a rack height adjusting assembly with a rack resting on a first horizontal section of a continuous track and the assembly in an extended position, according to an example of the present technology.

FIG. 9 shows an alternative to the detents for holding the rack in place in the extended position. Instead there may be a post and receiver arrangement similar to a pen and pen cap. In this example there would be at least one post 158 that depends from the cross-bar 128 or from the guide bars 112 at their distal ends 114 and at least one corresponding post receiver 160 that depends from rack 118. The post 158 would then releasably lock into a corresponding post receiver 160 to retain the rack 118 in the extended position. A further alternative to this example would instead have the post depending from the rack and the receiver depending from the cross-bar or guide bar. Another example would have the post and receiver releasably retained to one another by magnets.

While the present technology has been described in connection with what are presently considered to be the most practical and preferred examples, it is to be understood that the technology is not to be limited to the disclosed examples, but on the contrary, is intended to cover various modifications and equivalent arrangements included within the spirit and scope of the technology.

What is claimed is:

1. A rack height adjusting assembly for use in an appliance, the assembly comprising:

at least one inner bar configured to be fixedly attached to an interior wall of the appliance, each inner bar having an inner end and an outer end;

at least one guide bar having a distal guide bar end and a proximal guide bar end, said at least one guide bar being movable relative to said at least one inner bar, said proximal guide bar end of said at least one guide bar being adapted to be releasably attached to the outer end of the at least one inner bar such that said at least one guide bar and said at least one inner bar define a continuous track when attached, said continuous track having a first horizontal section and a second horizontal section, said first and second horizontal sections being positioned at different heights when said proximal guide bar end of said at least one guide bar is releasably attached to the outer end of the at least one inner bar; and a rack adapted to move along the continuous track between a retracted position, in which the rack is directly supported on the at least one inner bar at said first horizontal section, and an extended position, in which the rack is directly supported on the at least one guide bar at said second horizontal section, wherein the rack is positioned at different heights at said first horizontal section and at said second horizontal section.

2. The rack height adjusting assembly of claim 1, wherein the proximal guide bar end of the at least one guide bar is adapted to be rotatably attached to the outer end of the at least one inner bar.

3. The rack height adjusting assembly of claim 1, wherein the at least one guide bar is adapted to move longitudinally relative to the at least one inner bar.

4. The rack height adjusting assembly of claim 3, further comprising at least one extendable support bar having a proximal support bar end and a distal support bar end, wherein said proximal support bar end is configured to be fixedly attached to the interior wall of the appliance and said distal support bar end is fixedly attached to the guide bar.

5. The rack height adjusting assembly of claim 3, further comprising:

at least two wheels attached longitudinally and coplanar at the proximal guide bar end of the at least one guide bar; and a longitudinal channel disposed on the at least one inner bar and adapted to rollably attach the proximal guide bar end of the at least one guide bar by the at least two wheels.

6. The rack height adjusting assembly of claim 1, wherein the guide bar is substantially S-shaped.

7. The rack height adjusting assembly of claim 1, further comprising at least one cross bar connecting at least two of the at least one guide bars.

8. The rack height adjusting assembly of claim 1, wherein the rack is rollably supported on the continuous track by a plurality of wheels.

9. The rack height adjusting assembly of claim 1, wherein the rack moves along the continuous track by sliding.

10. The rack height adjusting assembly of claim 1, wherein the first horizontal section is substantially defined on the at least one inner bar.

11. The rack height adjusting assembly of claim 10, wherein the second horizontal section is substantially defined on the at least one guide bar.

12. The rack height adjusting assembly of claim 1, further comprising a handle for pulling out the rack.

13. The rack height adjusting assembly of claim 1, wherein the proximal guide bar end of the at least one guide bar is adapted to be releasably locked into the outer end of the at least one inner bar by a snap fit.

14. The rack height adjusting assembly of claim 1, wherein the first horizontal section is lower than the second horizontal section.

15. The rack height adjusting assembly of claim 1, wherein the first horizontal section is higher than the second horizontal section.

16. The rack height adjusting assembly of claim 1, wherein the rack is outside of the appliance when in the extended position.

17. An appliance, comprising:

an inner chamber having an interior wall;

a door to access the inner chamber; and the rack height adjusting assembly of claim 1.

18. The rack height adjusting assembly of claim 17, wherein the appliance is a dishwasher or an oven.

19. A method for facilitating loading and unloading of items to be treated in an appliance having at least one guide bar with a proximal guide bar end and a distal guide bar end, and at least one inner bar having an inner end and an outer end, the at least one inner bar being fixedly attached to an interior wall of the appliance, the method comprising:

pulling out the at least one guide bar from the appliance, said at least one guide bar being movable relative to the at least one inner bar;

releasably attaching said at least one guide bar at its proximal guide bar end to the at least one inner bar at the outer end to form a continuous track; and moving a rack along the continuous track from a retracted position, in which the rack is directly supported on the at least one inner bar at a first height, to an extended position, in which the rack is directly supported on the at least one guide bar at a second height, such that the rack moves from said first height to said second height that is different from the first height.

20. The method of claim 19, further comprising releasably locking said at least one guide bar at its proximal end to the at least one inner bar at its outer end by a snap fit to form a continuous track.

21. The method of claim 20, further comprising rotating the at least one guide bar about its proximal end, said proximal end adapted to be rotatably attached to the outer end of the at least one inner bar.

22. The method of claim 20, further comprising extending an at least one extendable support bar having a proximal support bar end and a distal support bar end, wherein said proximal support bar end is fixedly attached to the interior wall of the appliance and said distal support bar end is fixedly attached to the guide bar, wherein the at least one guide bar is adapted to move longitudinally relative to the at least one inner bar.

23. The method of claim 20, wherein the at least one guide bar is adapted to roll longitudinally relative to the at least one inner bar by at least two wheels attached longitudinally and parallel to the proximal end of the at least one guide bar, the at least two wheels being adapted to fit to a channel longitudinally disposed on the at least one inner bar.

24. The method of claim 20, wherein the rack is rollably supported on the continuous track by wheels.

25. The method of claim 20, wherein the rack moves along the continuous track by sliding.

26. The method of claim 19, further comprising pulling out the at least one guide bar with a handle attached near the distal end.

27. The method of claim 19, wherein two or more of the at least one guide bars are attached by at least one cross bar, such that the guide bars are adapted to move simultaneously relative to the at least one inner bar.

28. The method of claim 19, wherein the rack is outside of the appliance when moved to the second height.

29. The method of claim 19, wherein the second height is higher than the first height.

30. The method of claim 19, wherein the first height is higher than the second height.

31. The method of claim 19, wherein the guide bar is substantially S-shaped.

32. The method of claim 19, wherein the appliance is a dishwasher or an oven.

33. The method of claim 19, wherein pulling out the at least one guide bar and moving the rack are performed simultaneously.

34. The method of claim 33, further comprising pushing the at least one guide bar into the appliance simultaneously with moving the rack from the at least one guide bar to the at least one inner bar such that the rack moves from the second height to the first height.

35. The method of claim 19, wherein pulling out the at least one guide bar is performed before moving the rack.

36. The method of claim 35, further comprising moving the rack from the at least one guide bar to the at least one inner bar such that the rack moves from the second height to the first height; and subsequently pushing the at least one guide bar into the appliance.

* * * * *